US006641391B1

(12) United States Patent
Xu

(10) Patent No.: US 6,641,391 B1
(45) Date of Patent: Nov. 4, 2003

(54) SIDE ACTUATION PIEZOELECTRIC LIGHTER

(76) Inventor: Wen Xu, 405, 3RD Building Henghenanxincun Wenzhou, Zhejiang (CN)

( * ) Notice: Subject to any disclaimer, the term of this patent is extended or adjusted under 35 U.S.C. 154(b) by 0 days.

(21) Appl. No.: 10/178,640

(22) Filed: Jun. 25, 2002

(51) Int. Cl.[7] ..... F23Q 7/12; F23D 11/36
(52) U.S. Cl. ..... 431/255; 431/256; 431/153
(58) Field of Search ..... 431/255, 153, 431/256

(56) References Cited

U.S. PATENT DOCUMENTS 3,494,710 A * 2/1970 Inagaki ..... 431/143
5,310,336 A * 5/1994 Segawa ..... 431/131
5,531,591 A * 7/1996 Yamazaki ..... 431/153
6,099,300 A * 8/2000 Rice ..... 431/255
6,431,853 B1 * 8/2002 Sher ..... 431/153

* cited by examiner

*Primary Examiner*—Alfred Basichas

(57) ABSTRACT

A side actuation arrangement is incorporated with a piezoelectric lighter and includes a depressing button movably disposed in an ignition cavity of a lighter case and adapted to depress a movable operating part of a piezoelectric unit, and a side actuation member provided and being actuated on a front or rear side of the lighter case to drive the depressing member to depress the movable operating part of the piezoelectric unit so as to ignite the piezoelectric lighter. Therefore, the depressing button is hidden by the sidewall of the lighter case so as to prevent the piezoelectric lighter from being ignited unintentionally.

8 Claims, 8 Drawing Sheets

SIDE ACTUATION PIEZOELECTRIC LIGHTER

BACKGROUND OF THE PRESENT INVENTION

1. Field of Invention

The present invention relates to a lighter, and more particularly to a side actuation piezoelectric lighter which comprises an actuation member provided and being actuated on a front or rear side of the lighter case to actuate a depressing button which is hidden in the lighter case for igniting the piezoelectric lighter.

2. Description of Related Arts

A conventional piezoelectric lighter generally comprises a lighter case and an ignition system disposed in the lighter case, wherein the ignition system comprises a fuel storage chamber for storing liquefied fuel, a gas emitting nozzle communicated with fuel storage chamber, a piezoelectric unit arranged for producing a spark towards the gas emitting nozzle, and a pusher button communicated with the gas emitting nozzle via a lever.

Hence, when the pusher button is depressed downwardly, the lever is arranged to lift up the gas emitting nozzle for releasing gaseous fuel, and, at the same time, the movable operating part of the piezoelectric unit is depressed downwardly to produce a spark at the ignition tip such that the gaseous fuel ejecting from the gas emitting nozzle is then ignited by the spark.

According to the construction of the conventional piezoelectric lighter, the pusher button is provided on a top side of the lighter case in such a manner that a user of the lighter has to either depress the pusher button downwardly or slide the pusher button radially in order to ignite the piezoelectric lighter. On of the reasons for such structure is that the user is able to conveniently ignite the lighter.

However, such convenient structure also creates some repercussions. First, the conventional piezoelectric lighters may cause undesirable ignitions, especially by children. As a matter of facts, the appearances and the operation procedures of most conventional piezoelectric lighters are similar. Driven by curiosity, a child may easily recognize that there is a lighter in a certain place and he or she can easily reach and ignite it for fun. Although safety locks are incorporated with some lighters to block the movement of the pusher button, most of them are simple enough that children can easily figure out a way to unlock them.

Besides, since the pusher buttons are conventionally constructed on the top sides of the lighter cases of most of the piezoelectric lighters respectively, it largely limits the appearance of the light case of the piezoelectric lighter. Such top pusher button also prevents the industry designers to create any ornament design without a pusher button equipped thereon.

SUMMARY OF THE PRESENT INVENTION

A main object of the present invention is to provide a side actuation piezoelectric lighter, wherein a side actuation member is provided and being actuated on a front or rear side of the lighter case for igniting the piezoelectric lighter.

Another object of the present invention is to provide a side actuation piezoelectric lighter wherein an interior depressing button is incorporated with the side actuation member, so that the children may not find out how to operate the lighter or even do not know that the present invention is actually a lighter, so as to prevent children from igniting the lighter.

Another object of the present invention is to provide a side actuation piezoelectric lighter, wherein its lighter case can be designed and crafted to a variety of shapes and models without affecting the operation of the lighter, so as to enhance the aesthetic appearance of the piezoelectric lighter.

Another object of the present invention is to provide a side actuation piezoelectric lighter, wherein the ignition of the piezoelectric lighter of the present invention merely requires a simple single-action operation by an adult instead of the convention double-action operation.

Another object of the present invention is to provide a side actuation piezoelectric lighter, wherein no expensive or complicated mechanism is required to employ in the piezoelectric lighter, so as to minimize the manufacturing and marketing cost of the piezoelectric lighter of the present invention.

Accordingly, in order to accomplish the above objects, the present invention provides a side actuation piezoelectric lighter, comprising:

- a lighter case receiving a fuel storage and having an ignition cavity provided therein;
- an ignition system, which comprises:
  - a gas emitting nozzle communicated with the fuel storage for controlling a flow of gaseous fuel; and
  - a piezoelectric unit disposed in the ignition cavity, wherein the piezoelectric unit comprises a main piezoelectric body, a movable operating part slidably extended therefrom, and a spark generating tip extended to a position close to the gas emitting nozzle, wherein when the movable operating part is depressed with respect to the main piezoelectric body, the spark generating tip generates sparks to ignite the gaseous fuel emitted from the gas emitting fuel; and
- a side actuation arrangement, which comprises:
  - a depressing button which is movably disposed in the ignition cavity and arranged to depress the movable operating part of the piezoelectric unit; and
  - a side actuation member provided and being actuated on a front or rear side of the lighter case to drive the depressing member to depress the movable operating part of the piezoelectric unit so as to ignite the piezoelectric lighter.

DETAILED DESCRIPTION OF THE PREFERRED EMBODIMENT

Figure 1:
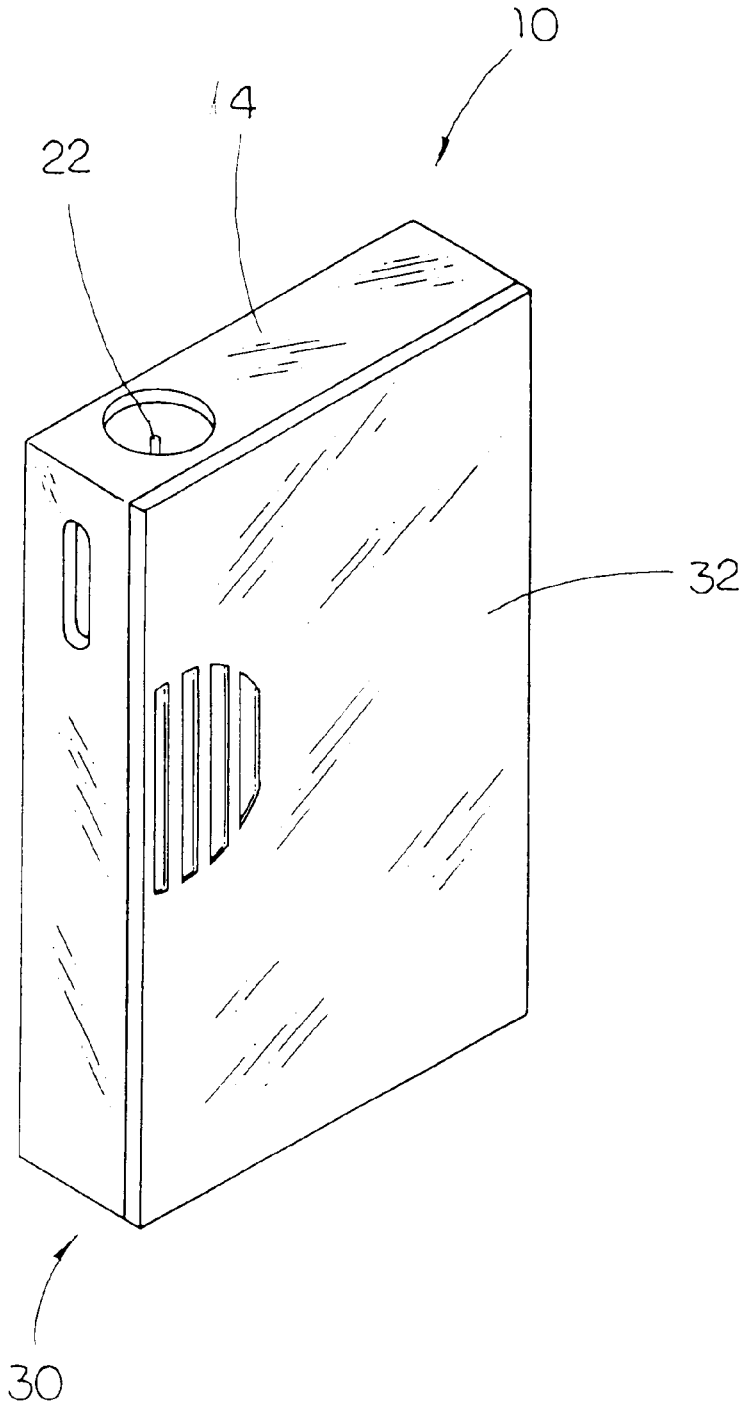
FIG. 1 is a perspective view of a side actuation piezoelectric lighter according to a first preferred embodiment of the present invention.

Referring to FIG. 1 of the drawings, a side actuation piezoelectric lighter according to a first preferred embodiment of the present invention is illustrated wherein the piezoelectric lighter comprises a lighter case 10 receiving a fuel storage 11 and having an ignition cavity 12 provided therein, an ignition system 20 disposed in the ignition cavity 12, and a side actuation arrangement 30.

The ignition system 20 comprises a gas-emitting nozzle 22, and a piezoelectric unit 23. The gas emitting nozzle 22 is communicated with the fuel storage 11 via a gas releasable valve 21 wherein the gas releasable valve 21 is adapted to be lifted up for releasing the gaseous fuel stored in the fuel storage 11.

The piezoelectric unit 23, which is disposed in the ignition cavity 12 of the lighter case 10, comprises a main piezoelectric body 231, a movable operating part 232 slidably and movably extended from the main piezoelectric body 231, and a spark generating tip 233 extended from the main piezoelectric body 231 to a position close to the gas emitting nozzle 22, wherein when the movable operating part 232 is depressed towards the main piezoelectric body 231, the spark generating tip 233 generates sparks to ignite the gaseous fuel emitted from the gas emitting fuel 22.

The side actuation arrangement 30 comprises a depressing button 31, which is movably disposed in the ignition cavity 12 and arranged to depress the movable operating part 232 of the piezoelectric unit 23, and a side actuation member 32 provided and being actuated on a front or rear side of the lighter case 10 to drive the depressing member 31 to depress the movable operating part 232 of the piezoelectric unit 23 so as to ignite the piezoelectric lighter.

According to the first preferred embodiment, the lighter case 10 which is in a box shape has a front and a rear sidewall 13 to define the ignition cavity 12 therebetween, a top wall 14, and a bottom wall 16, wherein the gas emitting nozzle 22 is appearing on the top wall 14 of the lighter case 10. The side actuation member 32 is provided on at least one of the sidewalls 13 in such a manner that the actuation member 32 is able to drive the depressing member 31 to depress the movable operating part 232 of the piezoelectric unit 23.

Figure 2:
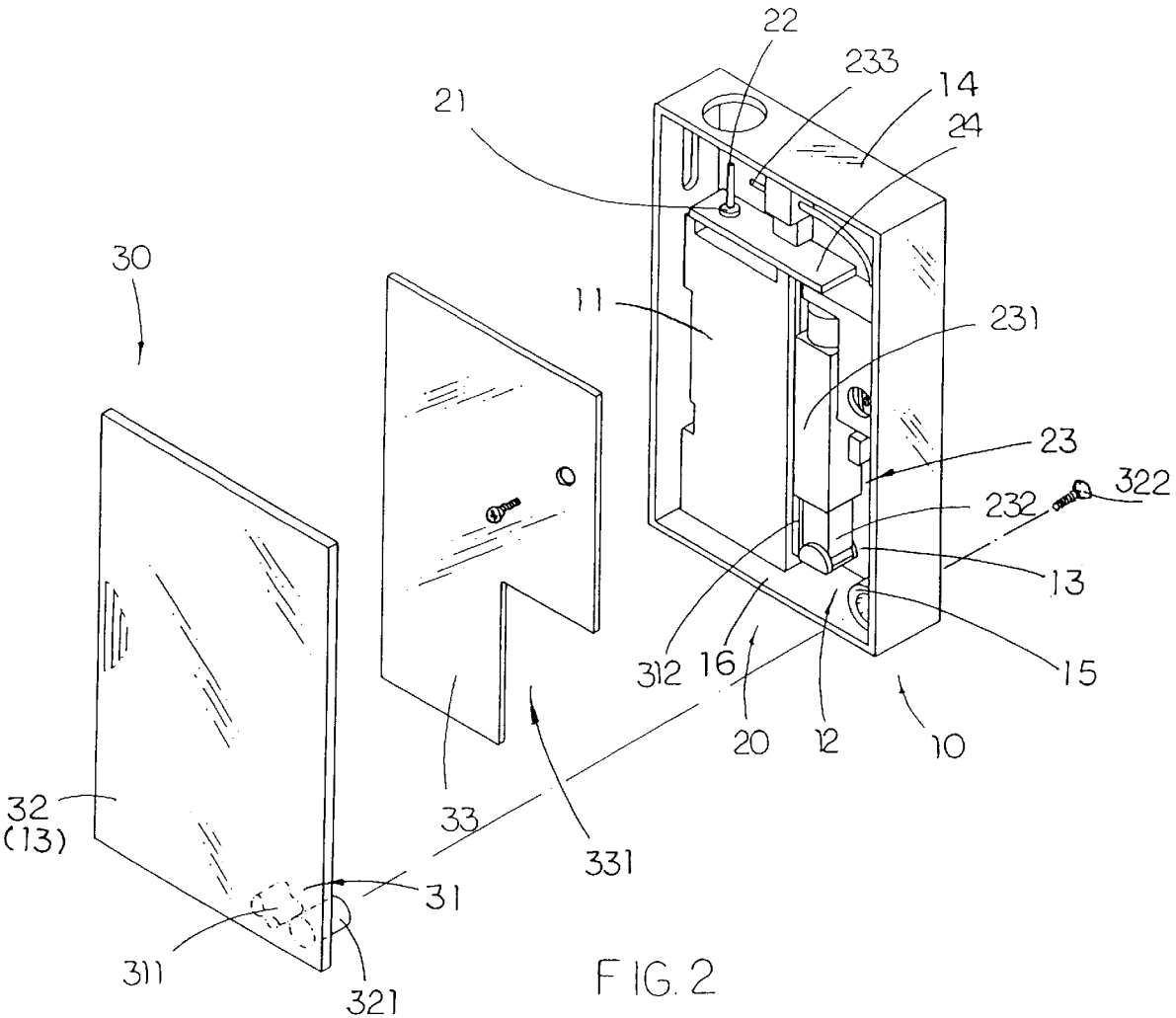
FIG. 2 is a sectional side view of the side actuation piezoelectric lighter according to the above first preferred embodiment of the present invention.

As shown in FIG. 2, the depressing button 31 comprises a depressing head 311 supported in the ignition cavity 12 at a position aligning with the movable operating part 232 of the piezoelectric unit 23, wherein the depressing head 311 is arranged to move towards the movable operating part 232 of the piezoelectric unit 23 so as to depress the piezoelectric unit 23.

In order to lift up the gas releasable valve 21, the depressing button 31 further comprises a driving arm 312 movable mounted on the piezoelectric unit 23 and arranged in such a manner that when the movable operating part 232 of the piezoelectric unit 23 is depressed, the driving arm 312 biases against a gas lever 24 to uplift the gas releasable valve 21 for releasing the gaseous fuel through the gas emitting nozzle 22. As shown in FIG. 2, the gas lever 24 is pivotally supported in the ignition cavity 12 and engaged with the gas releasable valve 21. In other words, when the depressing head 311 depresses the movable operating part 232 of the piezoelectric unit 23 to generate the sparks, the driving arm 312 will simultaneously lift up the gas releasable valve 21 such that the gas emitted from the gas emitting nozzle 22 is ignited.

According to the first preferred embodiment, the side actuation member 32 is embodied to construct as one of the sidewalls 13 of the lighter case 10 to enclose the ignition cavity 12. The side actuation member 32 is slidably mounted on the lighter case 10 rotatably about a pivot axle 321 which is inwardly protruded from a bottom corner of the side actuation member 32, wherein a tubular axle holder 14 is integrally provided at a lower comer of the lighter case 10 inside the ignition cavity 12 and the pivot axle 321 is rotatably inserted into the axle holder 14, so that the side actuation member 32 is slidable from left to right about the pivot axle 321. A screw 322 can be used to screw in from outside of another sidewall 13 to connect the pivot axle 321 via the axle holder 14 so as to mount the side actuation member 32 to the lighter case 10.

Figure 3:
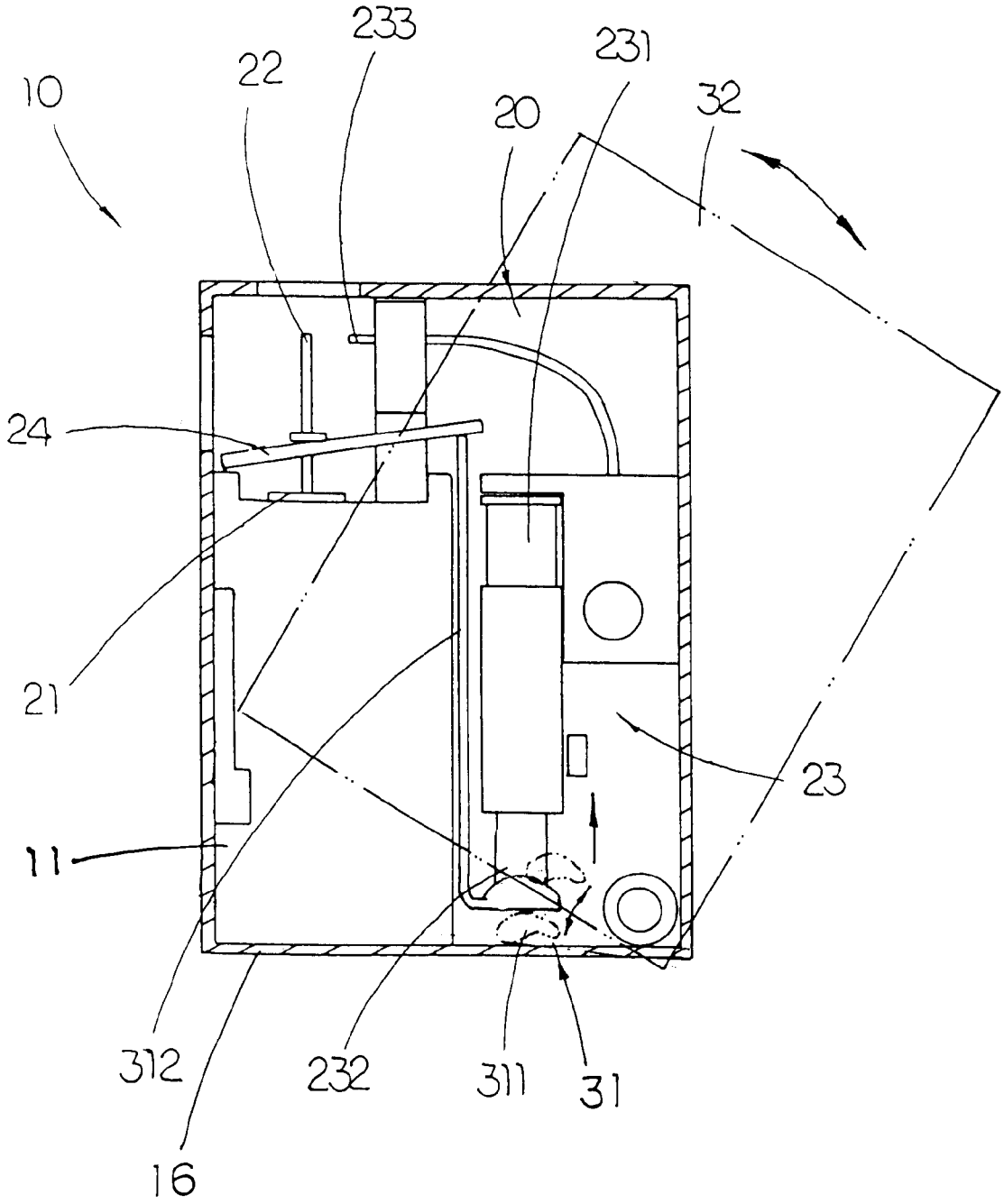
FIG. 3 is a schematic diagram of the side actuation piezoelectric lighter according to the above first preferred embodiment of the present invention.

The depressing head 311 of the depressing button 31 is integrally extended from an inner side of the side actuation member 32 to extend in the ignition cavity 12 and bias against the movable operating part 232 of the piezoelectric unit 23 in such a manner that when the side actuation member 32 is rotatably moved with respect to the lighter case 10, the depressing head 311 of the depressing button 31 is driven to depress the movable operating part 232 of the piezoelectric unit 23, so as to ignite the piezoelectric lighter, as shown in FIG. 3.

As shown in FIG. 2, the side actuation arrangement 30 further comprises a retaining panel 33 which is cover plate mounted on the lighter case 10 to cover the ignition cavity 12 and the fuel storage 11 so as to protect the ignition system 20. Alternatively, the retaining panel 33 can also be constructed as the sidewall 13 and thus the side actuation member 32 is mounted on the retaining panel 33, i.e. the sidewall 13. Therefore, either the retaining panel 33 or the side actuation member 32 can be constructed as the sidewall 13 of the lighter case 10.

The retaining panel 33 has a guiding slot 331 provided thereon in such a manner that when the side actuation member 32 is slidably overlapped on the retaining panel 33, the depressing head 311 of the depressing button 31 is extended from the side actuation member 32 into the ignition cavity 12 through the guiding slot 331. It is worth mentioning that when the side actuation member 32 is rotatably slid with respect to the lighter case 10 to ignite the piezoelectric lighter, the ignition cavity 12 may be exposed to outside. Therefore, the retaining panel 33 is capable of preventing an unwanted substance such as dust entering into the ignition cavity 12 to have an effect on the ignition system 20. Thus, the retaining panel 33 can retain the ignition system 20 in position.

Referring to FIGS. 2 and 3 of the drawings, the side actuation member 32, which is essentially a rectangular panel, is shaped and sized to rotatably mount on the lighter case 10 about an axle 18 provided at a lower corner portion of the lighter case 10 such that the side actuation member 32 is adapted to be slid downwardly and radially with respect to the lighter case 10.

The movable operating part 232 of the piezoelectric unit 23 is downwardly extended from the main piezoelectric body 231 thereof wherein the depressing head 311 of the depressing button 31 is extended from the side actuation member 32 to a position below the movable operating part 232 of the piezoelectric unit 23 in such a manner that when the actuation member 32 is downwardly and radially slid with respect to the lighter case 10, the depressing head 311 is driven to upwardly depress the movable operating art 232 of the piezoelectric unit 23 to ignite the piezoelectric lighter.

The depressing head 311 is arranged to be normally positioned between a pushing end of the movable operating part 232 and the bottom wall 16 of lighter case 10, in which it is preferred that a top side of the depressing head 311 is in contact with or bias against the pushing end of the movable operating part 232 while a bottom side of the depressing head 311 is in contact with the bottom wall 16 so that the bottom wall 16 can also block and limit the normal upright position of the side actuation member 32 as shown in FIGS. 1 and 3. Moreover, a radial distance is defined between the depressing head 311 and the pivot axle 321 and thus when the side actuation member 32 is rotated about the pivot axle 321, the depressing head 311 rotates about the pivot axle 321 along an accurate path. In other words, the depressing head 311 will displace upwards from the bottom wall 16 while sliding the side actuation member 32 sidewards to rotate about the pivot axle 321, so as to depress the movable operating part 232 to ignite the piezoelectric lighter.

When the sliding force applied to the side actuation member 32 is released after every single ignition, the compressed piezoelectric unit 23 will rebound to its original form such that the movable operating part 232 of the piezoelectric unit 23 will push the depressing head 311 downwardly so as to radially drive the side actuation member 32 to rotate back to its original position through the depressing head 311. Of course, it would be understood that additional resilient element can be included in the side actuation arrangement 30 for driving the side actuation member 32 back to the original position from the ignition position as mentioned above.

Figure 4:
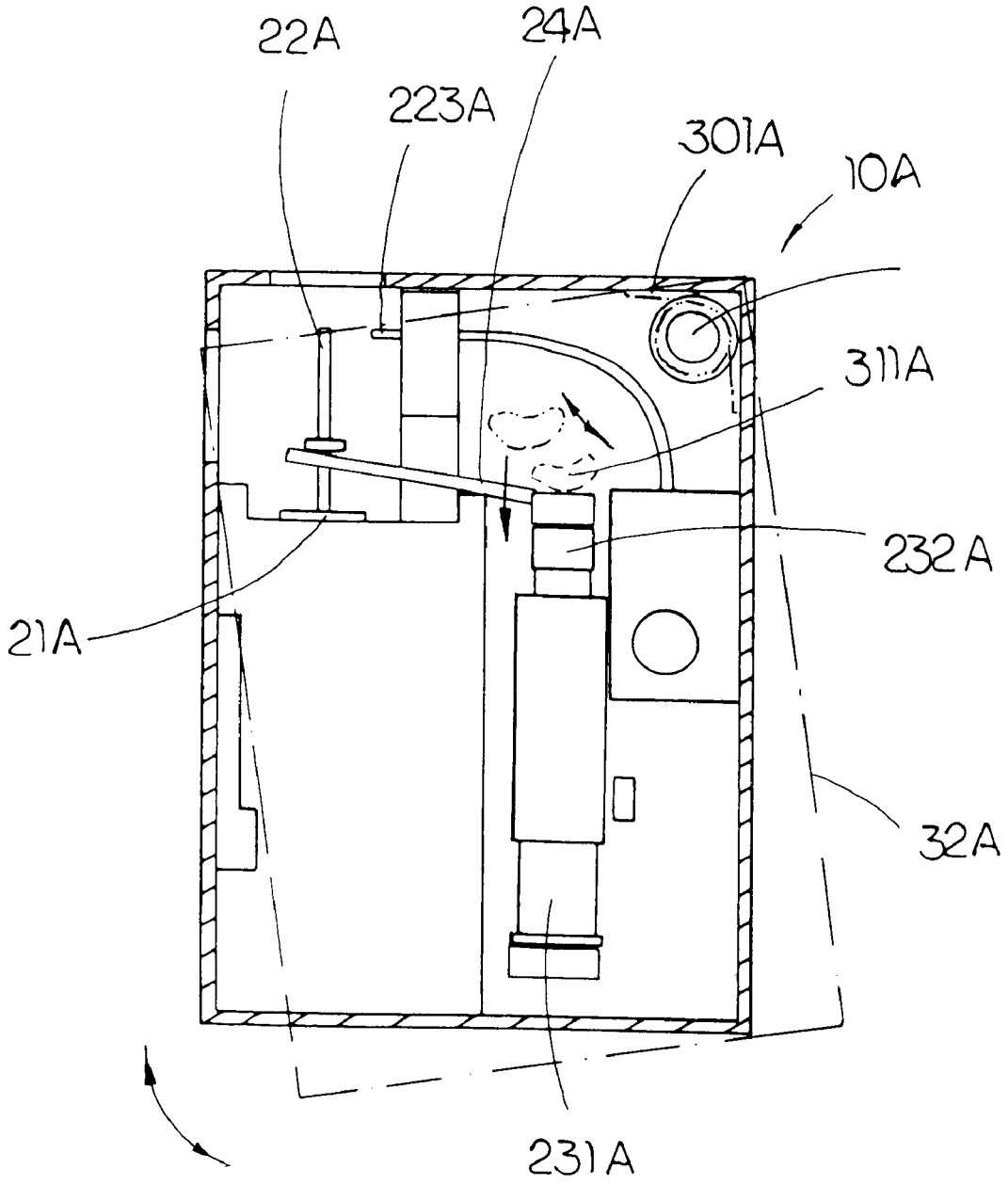
FIG. 4 illustrates an alternative mode of the side actuation arrangement incorporated with the side actuation piezoelectric lighter according to the above first preferred embodiment of the present invention.

FIG. 4 illustrates an alternative mode of the side actuation arrangement 30A of the side actuation piezoelectric lighter according to the first preferred embodiment of the present invention, wherein the piezoelectric lighter comprises the same components as mentioned above, except the ignition operation of the piezoelectric lighter.

As shown in FIG. 4, the side actuation member 32A is essentially a rectangular panel pivotally mounted on the lighter case 10A about the pivot axle 1321A provided at a top comer portion of the lighter case 10A such that the side actuation member 32A is adapted to be slid upwardly and radially with respect to the lighter case 10A.

Accordingly, the movable operating part 232A of the piezoelectric unit 23A is upwardly extended from the main piezoelectric body 231A thereof wherein the depressing head 311A of the depressing button 311A is extended from the side actuation member 32A to a position right above the movable operating part 232A of the piezoelectric unit 23A in such a manner that when the actuation member 32A is downwardly and radially slid with respect to the lighter case 10A, the depressing head 311A is driven to downwardly depress the movable operating part 232A of the piezoelectric unit 23A to ignite the piezoelectric lighter. In addition, the side actuation arrangement 30 further comprises a resilient element 301A for driving the side actuation member 32A back to the original position from the ignition position as mentioned above.

The main spirit of the present invention is that by providing the side actuation member 32 at a front side or a rear side of the piezoelectric lighter, the pusher button employed in the conventional piezoelectric lighter is substituted by the depressing button 31 concealed in the lighter case 10. Therefore, the side actuation arrangement 30 allows the appearance piezoelectric lighter to be designed and crafted to a decorative article or look like and utility things instead of lighters, thus to prevent children from paying attention to it. In other words, depressing button 31 is hidden in the lighter case 10 to prevent the ignition operation by the children. For example, as in the above first preferred embodiment, the side actuation member 32 can be designed as though it is a playing card rather than a trigger of the piezoelectric lighter.

Figure 5:
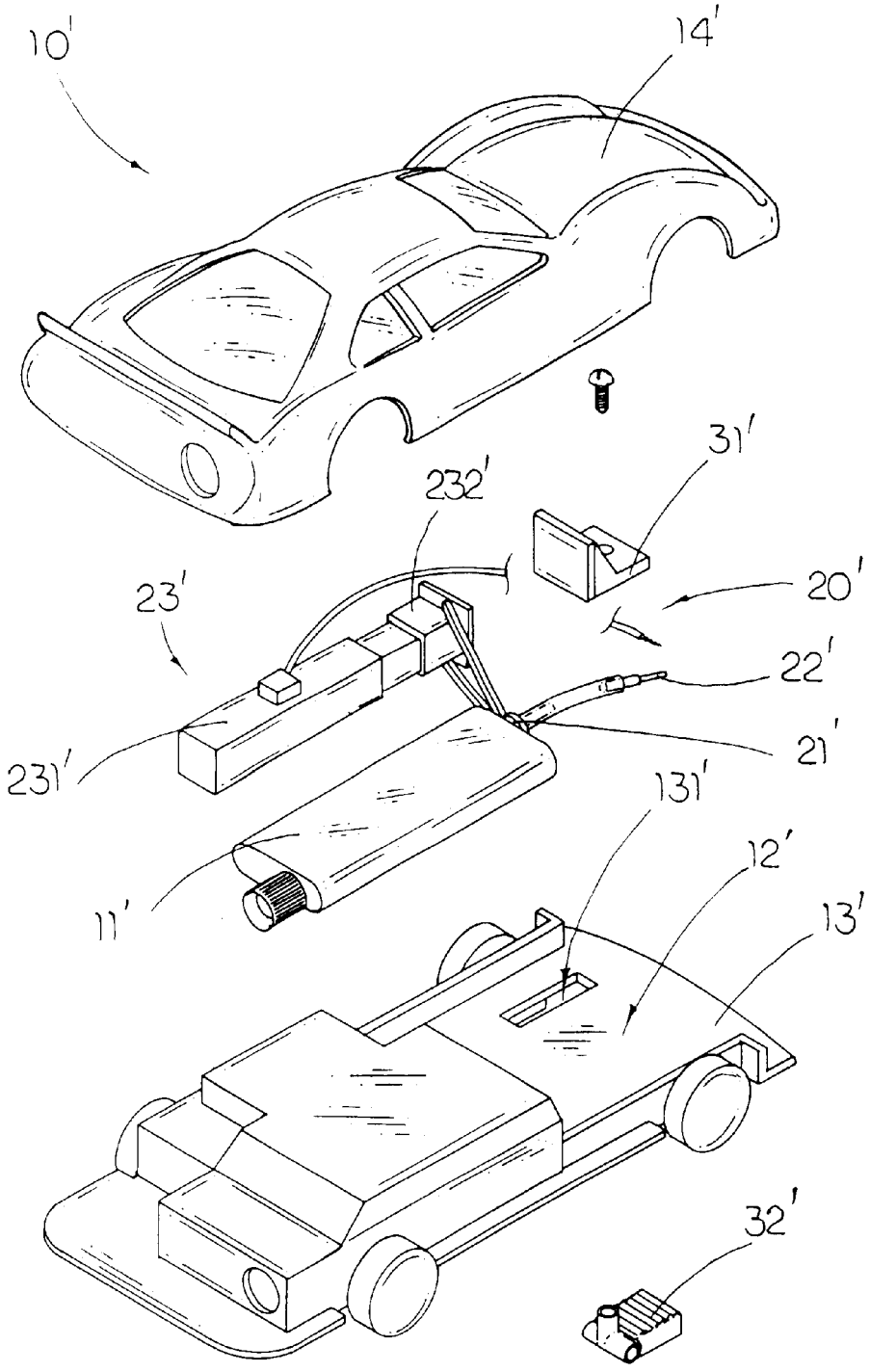
FIG. 5 is an exploded perspective view of a side actuation piezoelectric lighter according to a second preferred embodiment of the present invention.
Figure 6:
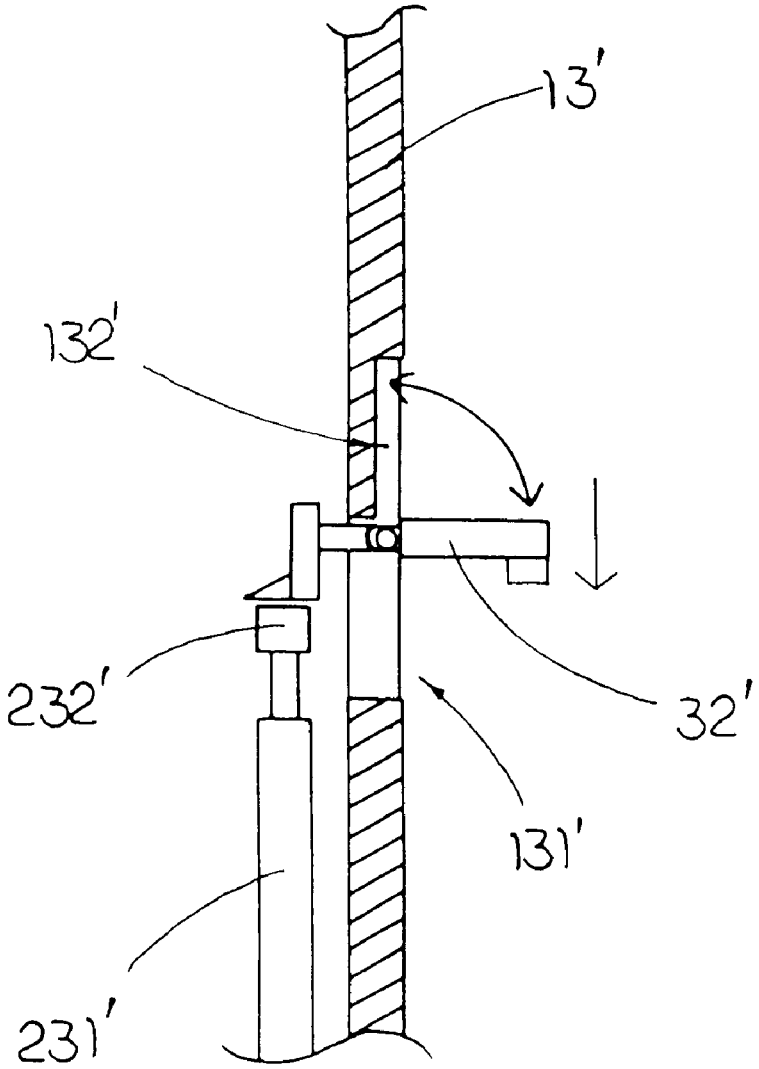
FIG. 6 is a partially side view of the side actuation piezoelectric lighter according to the above second preferred embodiment of the present invention.

Referring to FIG. 5 of the drawings, a second embodiment of a side actuation piezoelectric lighter illustrates an alternative mode of the first preferred embodiment of the present invention. Basically, the piezoelectric lighter of the second embodiment comprises the same components of the first embodiment. However, the lighter case 10' is capable of constructing any shape and size other than the shape of the conventional lighter.

According to the second embodiment, the lighter case 10' is constructed to have a figurine shape such as a vehicle toy. The lighter case 10' receives a fuel storage 11' and has an ignition cavity 12' provided therein, wherein the sidewall 13' of the lighter case 10' has a guider slot 131' for communicating the ignition cavity 12' with outside and a receiving cavity 132' integrally extended from the guider slot 131'.

The ignition system 20' comprises a gas-emitting nozzle 22', and a piezoelectric unit 23' wherein the gas emitting nozzle 22' is communicated with the fuel storage 11' via a gas releasable valve 21' wherein the gas releasable valve 21' is adapted to be lifted up for releasing the gaseous fuel stored in the fuel storage 11'.

The depressing button 31' of the side actuation arrangement 30' is disposed in the ignition cavity 12' at a position above the movable operating part 232' of the piezoelectric unit 23'.

The side actuation member 32' is slidably mounted on the sidewalls 13' in a linear movable manner wherein the side actuation member 32' is extended from the depressing button 31' through the guider slot 131' and is arranged to drive the depressing button 31' downwardly to depress the movable operating part 232' of the piezoelectric unit 23' with respect to the main piezoelectric body 231' thereof so as to ignite the piezoelectric lighter.

Moreover, the side actuation member 32' is pivotally coupling with the depressing button 31' through the guider slot 131' in such a manner that the side actuation member 32' is adapted to pivotally fold up into the receiving cavity 132' so as to conceal the side actuation member 32' on the sidewall 13' of the lighter case 10'. Accordingly, the receiving cavity 132' is indented on the sidewall 13' of the lighter case 10' and has a predetermined depth adapted to receive the side actuation member 32' when the side actuation member 32' is pivotally folded up.

In other words, since the side actuation member 32' is hidden in the sidewall 13' and the lighter case 10' is shaped different from the conventional lighter, the side actuation member 32' will not adversely affect the overall appearance of the lighter and the child may not figure out the side actuation member 32' as a trigger to ignite the piezoelectric lighter.

In order to ignite the piezoelectric lighter, the adult must flip down the side actuation member 32' out of the receiving cavity 132'. Then, the adult can apply a downward force on the side actuation member 32' to drive the depressing button 31' downwardly along the guider slot 131' so as to depress the movable operating part 232' of the piezoelectric unit 23' to ignite the piezoelectric lighter.

It is worth mentioning that the lighter case 10' is designed and crafted as a toy of an automobile, wherein the two sidewalls 13', 14' are embodied as the bottom and top sides of the automobile respectively. Accordingly, the side actuation member 32' is embodied as a small component provided on the bottom side (the sidewall 13') of the automobile, so as to minimize the attraction from the side actuation member 32' to children, and to maximize the entertainment feature of the piezoelectric lighter.

Figure 7:
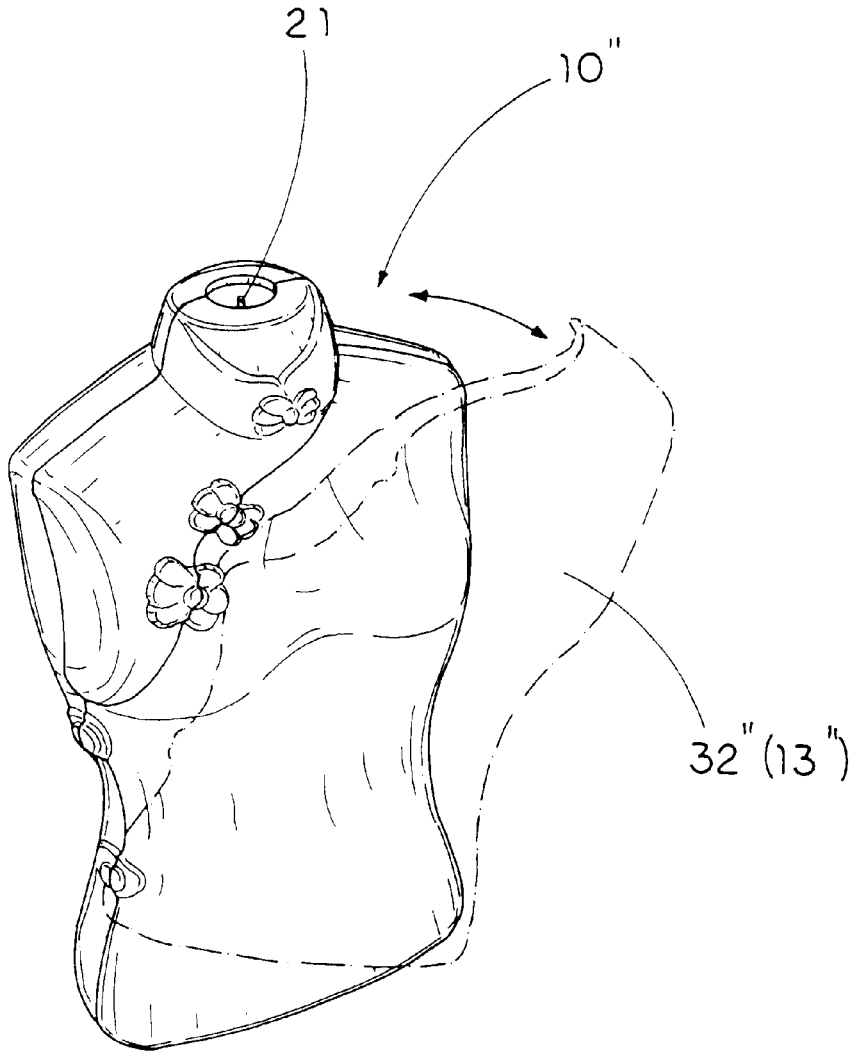
FIG. 7 is a perspective view of a side actuation piezoelectric lighter according to a third preferred embodiment of the present invention.
Figure 8:
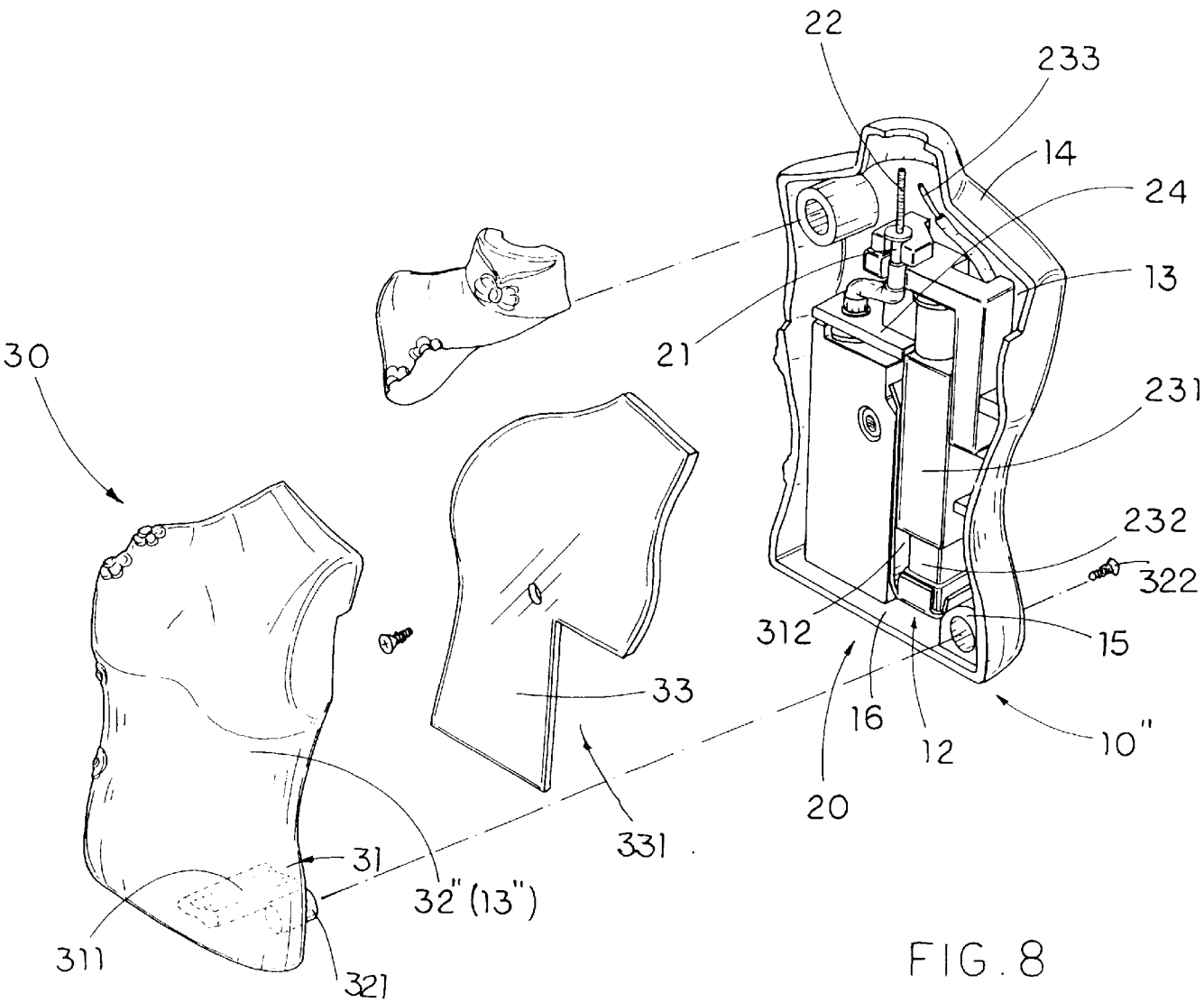
FIG. 8 is an exploded perspective view of the side actuation piezoelectric lighter according to the above third preferred embodiment of the present invention.

As shown in FIGS. 7 and 8, another alternative mode of the side actuation piezoelectric lighter according to the above preferred embodiments is illustrated, wherein all the components of the side actuation piezoelectric lighter have the same structural design of the first embodiment, except the design of the lighter case 10".

According to the third embodiment, the lighter case 10" is shaped and sized to have an ornamental design that different from the shape of the conventional lighter, wherein the side actuation member 32" is constructed to be the one of the sidewalls 13" of the lighter case 10" such that the side actuation piezoelectric lighter is ignited by radially and downwardly pushing the side actuation member 32" (13"), as shown in FIG. 7.

The main purpose of illustrating the such alternative mode is that the lighter case 10" of the side actuation piezoelectric lighter is capable of shaping into any aesthetic appearance wherein ignition operation only requires one of the sidewalls 13" of the lighter case 10" functioning as the side actuation member 32" to ignite the side actuation piezoelectric lighter. Therefore, the side actuation piezoelectric lighter can be constructed to any desirable shape to minimize the young child's attention from the non-lighter-liked shape of the present invention and to enhance the aesthetic appearance thereof.

Without violating the very spirit of the present invention, some variations based on the above-mentioned embodiment and alternatives should also be considered as equivalence. For example, the side actuation member can be folded and received in the ignition slot so that when the user wants to ignite the lighter, he/she can just simply unfold the side actuation member so as to depress the movable operating part of the piezoelectric lighter. Moreover, the side actuation member can be slidably mounted on the sidewall in a radially movable manner while the guider slot is formed to have an arc shape such that the side actuation member is adapted to drive the depressing button to depress the piezoelectric unit when the side actuation member is moved radially along the guider slot.

What is claimed is:

1. A piezoelectric lighter, comprising:

a lighter case receiving a fuel storage and having an ignition cavity provided therein;

an ignition system, which comprises:

a gas emitting nozzle communicated with said fuel storage for controlling a flow of gaseous fuel; and a piezoelectric unit disposed in said ignition cavity, wherein said piezoelectric unit comprises a main piezoelectric body, a movable operating part slidably extended therefrom, and a spark generating tip extended to a position close to said gas emitting nozzle, wherein when said movable operating part is depressed with respect to said main piezoelectric body, said spark generating tip generates sparks to ignite said gaseous fuel emitted from said gas emitting fuel; and a side actuation arrangement, which comprises:

a depressing button which is movably disposed in said ignition cavity and arranged to depress said movable operating part of said piezoelectric unit; and a side actuation member provided and being actuated on a side of said lighter case to drive said depressing member to depress said movable operating part of said piezoelectric unit so as to ignite said piezoelectric lighter, wherein said side actuation member is positioned in front of a sidewall of said lighter case and slidably mounted on said lighter case so as to depress said movable operating part of said piezoelectric unit by said depressing button through a guiding slot provided on said sidewall, wherein said side actuation member is pivotally connected to said lighter case so as to enable said side actuation member to rotatably slide about a pivot axle to drive said depressing button to depress said movable operating part of said piezoelectric unit to ignite said piezoelectric lighter.

2. The piezoelectric lighter, as recited in claim 1, wherein said pivot axle is inwardly protruded from said side actuation member, wherein an axle holder is provided in said ignition cavity of said lighter case, wherein said pivot axle is rotatably inserted into said axle holder, wherein said depressing button is coupled with said side actuation member and retained to normally position at a pushing end of said movable operating part of said piezoelectric unit in such a manner that when said side actuation is rotatably moved with respect to said lighter case, said depressing button is driven to depress said movable operating part to ignite said piezoelectric lighter.

3. The piezoelectric lighter, as recited in claim 2, wherein said depressing button comprises a depressing head integrally extended from an inner side of said side actuation member into said ignition cavity, wherein a radial distance is defined between said depressing head and said pivot axle and thus when said side actuation member is rotated about said pivot axle, said depressing head rotates about said pivot axle along an accurate path to depress said movable operating part of said piezoelectric unit.

4. The piezoelectric lighter, as recited in claim 3, wherein said pivot axle is positioned at a bottom corner of said side actuation member and said axle holder is positioned at an opposing bottom corner of said lighter case.

5. The piezoelectric lighter, as recited in claim 4, wherein said movable operating part of said piezoelectric unit is downwardly extended from said main piezoelectric body thereof, wherein said depressing head of said depressing button is extended from said side actuation member to a position below said pushing end of said movable operating part of said piezoelectric unit in such a manner that when said actuation member is downwardly and radially slid with respect to said lighter case, said depressing head is driven to upwardly depress said movable operating part of said piezoelectric unit to ignite said piezoelectric lighter.

6. The piezoelectric lighter, as recited in claim 2, further comprising means for retaining said side actuation member in a normal position that when a force applied to said side actuation member is released after every single ignition, said depressing button is driven back to bias against said pushing end of said movable operating part of said piezoelectric unit.

7. A piezoelectric lighter, comprising:

a lighter case receiving a fuel storage and having an ignition cavity provided therein;

an ignition system, which comprises:

a gas emitting nozzle communicated with said fuel storage for controlling a flow of gaseous fuel; and a piezoelectric unit disposed in said ignition cavity, wherein said piezoelectric unit comprises a main piezoelectric body, a movable operating part slidably extended therefrom, and a spark generating tip extended to a position close to said gas emitting nozzle, wherein when said movable operating part is depressed with respect to said main piezoelectric body, said spark generating tip generates sparks to ignite said gaseous fuel emitted from said gas emitting fuel; and a side actuation arrangement, which comprises:

a depressing button which is movably disposed in said ignition cavity and arranged to depress said movable operating part of said piezoelectric unit; and a side actuation member provided and being actuated on a side of said lighter case to drive said depressing member to depress said movable operating part of said piezoelectric unit so as to ignite said piezoelectric lighter, wherein said side actuation member is constructed as a sidewall of said lighter case to enclose said ignition cavity, wherein said side actuation member is slidably mounted on said lighter case in a rotatably movable manner so as to depress said movable operating part of said piezoelectric unit via said depressing button when said side actuation member is radially slid with respect to said lighter case, wherein said side actuation member is pivotally connected to said lighter case so as to enable said side actuation member to rotatably slide about a pivot axle to drive said depressing button to depress said movable operating part of said piezoelectric unit to ignite said piezoelectric lighter, wherein said pivot axle is inwardly protruded from said side actuation member, wherein an axle holder is provided in said ignition cavity of said lighter case, wherein said pivot axle is rotatably inserted into said axle holder, wherein said depressing button is coupled with said side actuation member and retained to normally position at a pushing end of said movable operating part of said piezoelectric unit in such a manner that when said side actuation is rotatably moved with respect to said lighter case, said depressing button is driven to depress said movable operating part to ignite said piezoelectric lighter, wherein said depressing button comprises a depressing head integrally extended from an inner side of said side actuation member into said ignition cavity, wherein a radial distance is defined between said depressing head and said pivot axle and thus when said side actuation member is rotated about said pivot axle, said depressing head rotates about said pivot axle along an accurate path to depress said movable operating part of said piezoelectric unit, wherein said pivot axle is positioned at a bottom corner of said side actuation member and said axle holder is positioned at an opposing bottom corner of said lighter case.

8. The piezoelectric lighter, as recited in claim 7, wherein said movable operating part of said piezoelectric unit is downwardly extended from said main piezoelectric body thereof, wherein said depressing head of said depressing button is extended from said side actuation member to a position below said pushing end of said movable operating part of said piezoelectric unit in such a manner that when said actuation member is downwardly and radially slid with respect to said lighter case, said depressing head is driven to upwardly depress said movable operating part of said piezoelectric unit to ignite said piezoelectric lighter.

* * * * *